US007053870B2

(12) United States Patent
Shoji et al.

(10) Patent No.: US 7,053,870 B2
(45) Date of Patent: May 30, 2006

(54) DRIVE METHOD FOR PLASMA DISPLAY PANEL AND PLASMA DISPLAY DEVICE

(75) Inventors: Takatoshi Shoji, Tokyo (JP); Mitsuhiro Ishizuka, Tokyo (JP)

(73) Assignee: Pioneer Corporation, Tokyo (JP)

( * ) Notice: Subject to any disclaimer, the term of this patent is extended or adjusted under 35 U.S.C. 154(b) by 432 days.

(21) Appl. No.: 10/126,583

(22) Filed: Apr. 22, 2002

(65) Prior Publication Data

US 2002/0190927 A1 Dec. 19, 2002

(30) Foreign Application Priority Data

Apr. 24, 2001 (JP) ..... 2001-125781

(51) Int. Cl.
*G09G 3/28* (2006.01)

(52) U.S. Cl. ..... 345/60; 345/68; 313/169.4

(58) Field of Classification Search ..... 345/60, 345/63, 66, 68, 55, 37, 41; 315/169.1, 169.3, 315/169.4; 313/581, 584
See application file for complete search history.

(56) References Cited

U.S. PATENT DOCUMENTS 5,841,413 A * 11/1998 Zhu et al. ..... 345/63
6,323,880 B1 * 11/2001 Yamada ..... 345/690
6,426,732 B1 * 7/2002 Makino ..... 345/68
6,429,834 B1 * 8/2002 Kanazawa et al. ..... 345/63
6,653,993 B1 * 11/2003 Nagao et al. ..... 345/60
6,667,728 B1 * 12/2003 Kanazawa et al. ..... 345/60

FOREIGN PATENT DOCUMENTS

JP 09-181059 7/1997
JP 10-207422 8/1998
JP 2000-347620 12/2000

OTHER PUBLICATIONS

Korean Office Action dated May 20, 2004 with English translation of pertinent portions.
Japanese translation of Korean Office Action dated May 21, 2004.

* cited by examiner

*Primary Examiner*—Amr A. Awad
*Assistant Examiner*—Abbas I. Abdulselam
(74) *Attorney, Agent, or Firm*—Drinker Biddle & Reath LLP

(57) ABSTRACT

When an average peak level is high, and there is a difference in weight between a subfield SF1 on the lowest level and a subfield SF2 on the second lowest level while their sustain cycle numbers are equal, all scan electrodes are scanned for the subfield SF1 on the lowest level. Simultaneously, data pulses according to video signals are impressed on data electrodes only when an odd number scan electrode is scanned in an odd number field (an nth frame), and the data pulses according to the video signals are impressed on the data electrodes only when an even scan number electrode is scanned in an even number field (an (n+1)th frame).

11 Claims, 11 Drawing Sheets

DRIVE METHOD FOR PLASMA DISPLAY PANEL AND PLASMA DISPLAY DEVICE

BACKGROUND OF THE INVENTION

1. Field of the Invention

The present invention relates to a drive method for a plasma display panel, and a plasma display device used for a flat type television set and an information display, and specifically relates to a drive method for a plasma display panel, and a plasma display device for preventing a reversal of luminance when a total sustain cycle number decreases.

2. Description of the Related Art

A plasma display panel (PDP) is provided with a plurality of scan electrodes, and sustain electrodes extending in the horizontal direction, and a plurality of data electrodes extending in the vertical direction. Display cells are provided at individual intersections between the scan and sustain electrodes, and the data electrodes. In this specification, the vertical direction and the horizontal direction mean a vertical direction and a horizontal direction when the plasma display device is used while it is hanged on a wall, and respectively correspond to a column direction and a row direction in a drawing. FIG. 1 shows a schematic drawing showing a relationship among electrodes for the plasma display panel.

A number (a) of scan electrodes Sc1 to Sca, and a number (a) of sustain electrodes Su1 to Sua extending in the horizontal direction are provided alternately, and data electrodes D1 to Db extending in the vertical direction are provided in orthogonal to the scan electrodes and the sustain electrodes in the plasma display panel as shown in FIG. 1. Generally, the scan electrodes and the sustain electrodes are provided on a front substrate (not shown), and the data electrodes are provided on a rear substrate (not shown). A discharge space is formed between the front substrate and the rear substrate. The sustain electrodes Su1 to Sua may be connected together. One display cell 101 is placed at each of intersections between the scan and sustain electrode, and the data electrode. Therefore, when (a) of the scan electrodes, (a) of the sustain electrodes, and (b) of the data electrodes are provided in the plasma display, there exist total of (a×b) of the display cells 101. For three display cells 101 successive in the horizontal direction, any one of them emits red light (R), any one of them emits green light (G), and any one of them emits blue light (B). These three display cells constitute one pixel.

A gradation expression method called as a subfield method is generally adopted in a plasma display panel. In the subfield method, one field (one frame) is divided into a plurality of subfields having different weights, and the gradation is determined by which subfields are selected. The subfield comprises a preliminary discharge period (a priming period), a write period (an address period), a sustain period, and an erase period in many drive methods.

There is a control method called as PLE (Peak Luminance Enhancement). The PLE controls a sustain cycle number (a sustain pulse number) for the individual subfields for every frame according to an average peak level (APL), and reduces a power consumption while increasing peak luminance. For example, the average peak level is large for an image display of a snow-covered mountain, and is small for an image display of a night sky. For the image of the snow-covered mountain, there is no large effect on the human vision when background luminance is slightly large. On the other hand, for the image of the night sky, because most of the display area may have background luminance itself, when the background luminance is high, the contrast largely decreases compared with the case of the snow-covered mountain. Thus, the sustain cycle number per field is decreased when the average peak level is high, and the sustain cycle number per field is increased when the average peak level is low in the PLE control.

A drive method is disclosed for decreasing a write period to secure a long sustain period, and to increase the luminance (Japanese Patent Laid-Open Publication No. Hei. 11-24628). FIG. 2 is a timing chart for showing a drive method similar to the drive method disclosed in the publication described above.

In the drive method disclosed in the publication, for example, one field comprises eight subfields, and all scan electrodes are scanned for the four upper level subfields having larger weights. A scan similar to interlace display is conducted for the four lower level subfields having smaller weights. Namely, the scan pulses are applied only on the odd number scan electrodes (mth (m: odd number), (m+2)th, (m+4)th, . . . ) for an odd number field (nth (n: odd number) frame), and the scan pulses are applied only on the even number scan electrodes ((m+1)th, (m+3)th, (m+5)th, . . . ) for an even number field ((n+1)th frame) as shown in FIG. 2. As a result, because the even number scan electrodes are not scanned in the odd number fields, and the odd number scan electrodes are not scanned in the even number fields, the write period is reduced accordingly, and the reduced amount of the period can be assigned for the sustain period. Also, though a line flicker may be remarkable in the interlace display, because the interlace display is limited to the lower level subfields, the influence of the line flicker is small.

However, when the average peak level is high in the PLE control, the sustain cycle number may be 1 in the plurality of lower subfields, namely in the subfields with smaller weights. Table 1 shows a relationship between the gradation level and selected subfields when the average peak level is high in the PLE control where one field comprises four subfields SF1 to SF4, and 11 gradation levels are realized.

TABLE 1

| | Subfield | SF1 | SF2 | SF3 | SF4 | |
|---|---|---|---|---|---|---|
| | Weight | 1 | 2 | 4 | 8 | |
| | Cycle number | 1 | 1 | 2 | 4 | Luminance |
| Gradation level | 0 | | | | | 0.84 |
| | 1 | ○ | | | | 2.08 |
| | 2 | | ○ | | | 2.08 |
| | 3 | ○ | ○ | | | 3.32 |
| | 4 | | | ○ | | 2.96 |
| | 5 | ○ | | ○ | | 4.20 |
| | 6 | | ○ | ○ | | 4.20 |
| | 7 | ○ | ○ | ○ | | 5.32 |
| | 8 | | | | ○ | 4.68 |
| | 9 | ○ | | | ○ | 5.92 |
| | 10 | | ○ | | ○ | 5.92 |

While Table 1 shows the eleven gradation levels, 16 gradation levels can be realized when one frame comprises four subfields.

When there are a plurality of subfields whose sustain cycle number is 1, there may be a reversal of the luminance, namely a case where a higher gradation level has lower luminance than a lower gradation level in two successive gradation levels. FIG. 3 is a chart showing a relationship between the gradation level and the luminance in Table 1. Because of the reversal of the luminance, there is a problem that a sufficient gradation expression is not realized.

When the method disclosed in Japanese Patent Laid-Open Publication No. Hei. 11-24628 is applied to the PLE control, because the sustain cycle number apparently increases, it is possible to prevent the reversal of the luminance. However, the interlace scan causes a change of an existing position of a displayed object within one filed, and the screen may momentarily become darker or brighter at a moment of a switching between a case where the write period is reduced and a case where the write period is not reduced, namely a switching between a frame where the lower four subfields are selected, and a frame where lower four subfields are not selected. As a result, the image quality degrades.

SUMMARY OF THE INVENTION

It is an object of the present invention to provide a drive method for a plasma display panel, and a plasma display device for preventing a reversal of luminance without degrading image quality when the PLE control is used.

The present invention is a method for driving a plasma display panel in which one field is constituted by a plurality of subfields, having a step of impressing a data pulse on a data electrode provided on individual display cells in one or more subfields of said plurality of subfields in association with a video signal to generate a write discharge for a gradation display on the plasma display panel. The step of impressing the data pulse comprises a step of impressing the data pulses only on the data electrodes of the predetermined display cells which is a part of all display cells without generating the write discharge in the remaining display cells in at least one subfield of said plurality of subfields.

With the present invention, the data pulse in association with the video signal is impressed on the data electrode only in the predetermined display cells in at least one subfield such as the lowest level subfields with the smallest weight of the plurality of subfields. Namely, the data pulse is not impressed at all on the data electrode in the other display cells. As a result, when the number of the predetermined display cells is a half of the total number of the display cells on the plasma display panel, the luminance of that subfield is reduced by half. If the number is one fourth of the number of the total display cells, the luminance of that subfield is reduced to one fourth. Thus, even when there are two subfields where the sustain cycle number is 1 in the PLE control and the like, if the number of the predetermined display cells is reduced to a half of the total number of the display cells in one of the subfields such as the lower level subfield, the reversal of the luminance is prevented. Also, because it is not necessary to skip impressing the scan pulse, the screen does not momentarily become darker or brighter, and an excellent image quality can be provided.

It is preferred that the at least one subfield described above be assigned with a sustain cycle number equal to that for the other subfields, and has a weight lower than those for the other subfields, and it is particularly preferred that the sustain cycle number equal to that for the other subfields be 1, and the sustain cycle number become virtually 1/N (N is an integer equal to 2 or more) in the at least one subfield.

It is preferred that the predetermined display cells constitute scan lines, the scan lines constituted by the predetermined display cells are provided at a ratio of one scan line in every N scan lines, and the data pulses are not impressed on the data electrodes on the remaining (N−1) scan lines. In this case, it is preferred that error diffusion be conducted only for data in the horizontal direction for the video signal. It is possible that the predetermined display cells constitute pixels, the pixels constituted by the predetermined display cells be provided at a ratio of one pixel in every N pixels, and the data pulses be not impressed on the data electrodes for the remaining (N−1) pixels. It is also possible that the predetermined display cells constitute blocks, the blocks constituted by the predetermined display cells are provided at a ratio of one block in every N blocks, and the data pulses are not impressed on the data electrodes for the remaining (N−1) blocks. In this case, one data driver is connected with data electrodes for the individual blocks, for example.

Further, it is possible to realize PLE control for preventing the reversal of the luminance. A plurality of total sustain cycle numbers are set in advance. And one of a total sustain cycle number is selected from the plurality of the total sustain cycle numbers in association with an average peak level of the video signal before impressing the data pulses associated with the video signal only on the data electrodes of the predetermined display cells. For example, when 32 to 10 are set in advance as the total sustain cycle numbers for 16 gradation level display (gradation level: 0 to 15), the following control is available. The PLE control is conducted such that the total sustain cycle number is 10 when the average peak level is maximum, namely when the gradation level is 15, and the total sustain cycle number is 32 when the average peak level is equal to or less than the gradation level of 5. In this way, it is possible to always restrain a power consumption for the sustain discharge to a level lower than a certain value. When the total sustain cycle number becomes from 15 to 10, using the drive method of the present invention always realizes a 16-gradation level display.

It is preferred that the predetermined display cells be changed once in every M (M is an integer equal to 2 or more) fields. It is especially preferred that the value of M be equal to the value of N.

The plasma display device according to the present invention comprises a plasma display panel, and a drive device for using the method according to any one of the aforementioned methods for driving a plasma display panel.

BRIEF DESCRIPTION OF THE DRAWINGS

FIG. 5 includes drawings showing a relationship between selectable display cells and unselectable display cells in the first embodiment of the present invention.

FIG. 7 includes drawings showing a relationship between selectable display cells and unselectable display cells in a second embodiment of the present invention.

FIG. 8 includes drawings showing a relationship between selectable display cells and unselectable display cells in a third embodiment of the present invention.

FIG. 9 includes drawings showing a relationship between selectable display cells and unselectable display cells in a fourth embodiment of the present invention.

FIG. 10 includes drawings showing a relationship between selectable display cells and unselectable display cells in the same fourth embodiment of the present invention.

DETAILED DESCRIPTION OF THE PREFERRED EMBODIMENT

Figure 1:
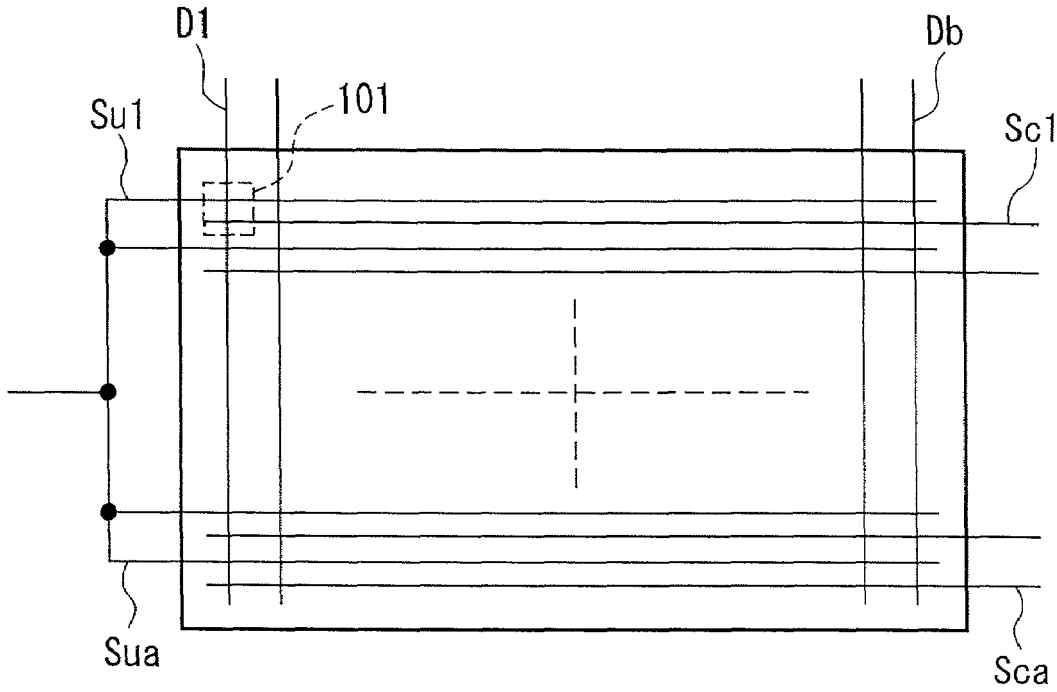
FIG. 1 (PRIOR ART)
FIG. 1 is a schematic drawing showing relationship among electrodes for a plasma display panel.
Figure 2:
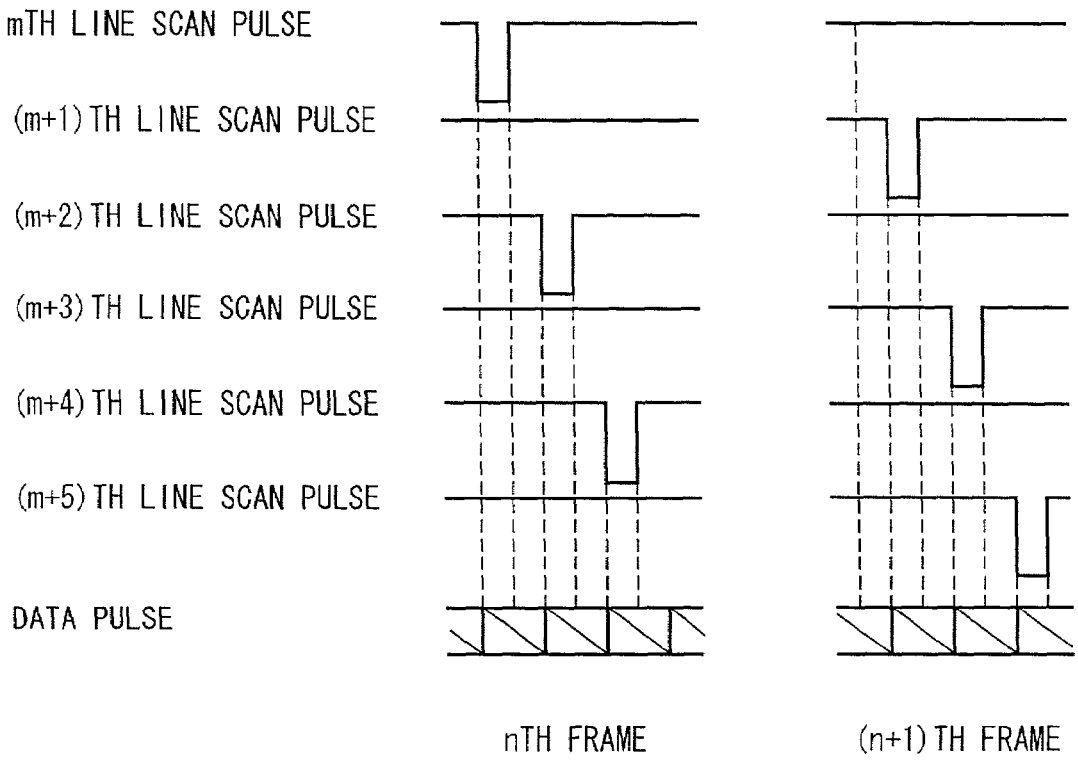
FIG. 2(PRIOR ART)
FIG. 2 is a timing chart showing a drive method similar to a drive method disclosed in Japanese Patent Laid-Open Publication No. Hei. 11-24628.
Figure 3:
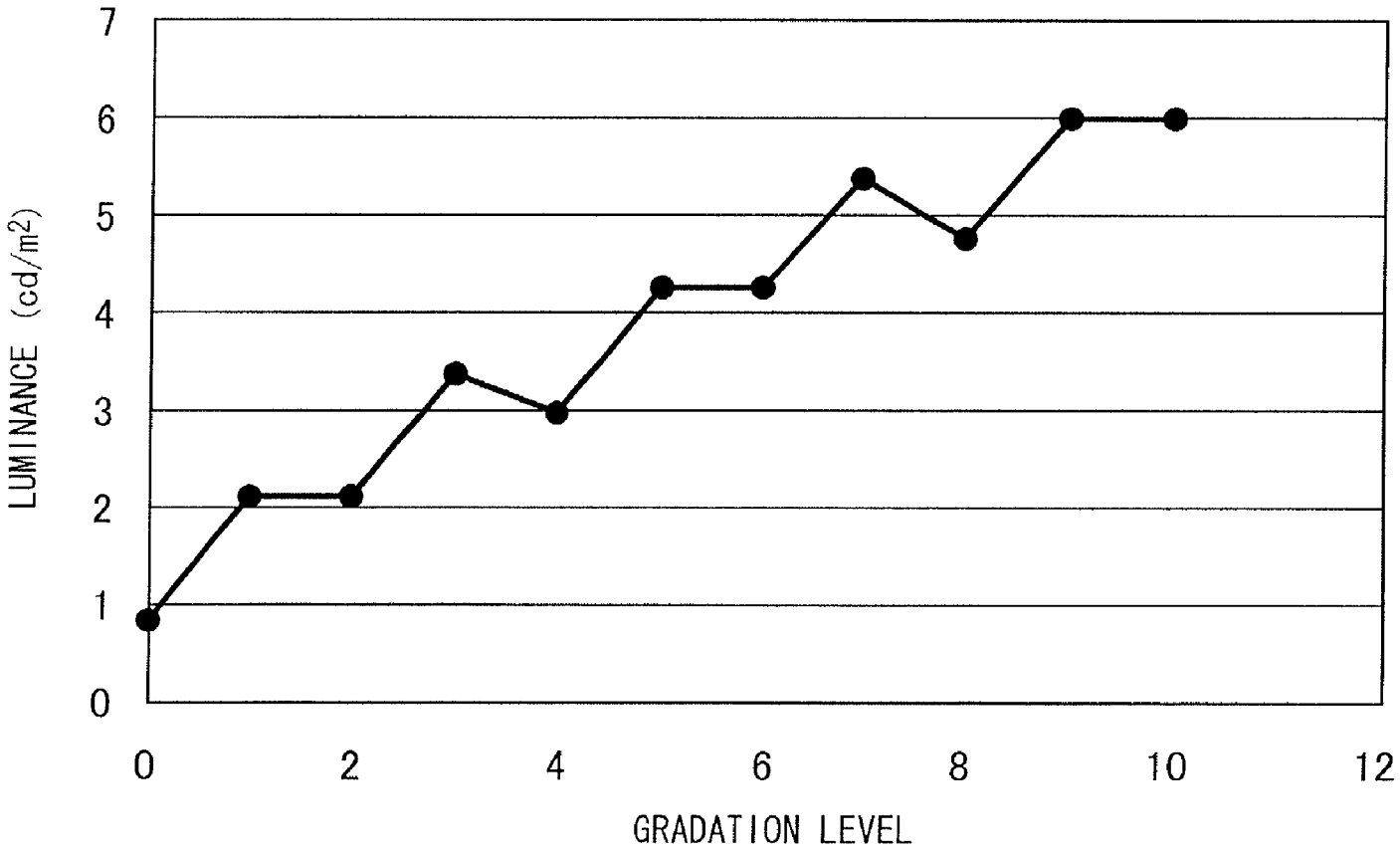
FIG. 3(PRIOR ART)
FIG. 3 is a chart showing a relationship between gradation level and luminance in Table 1.
Figure 4:
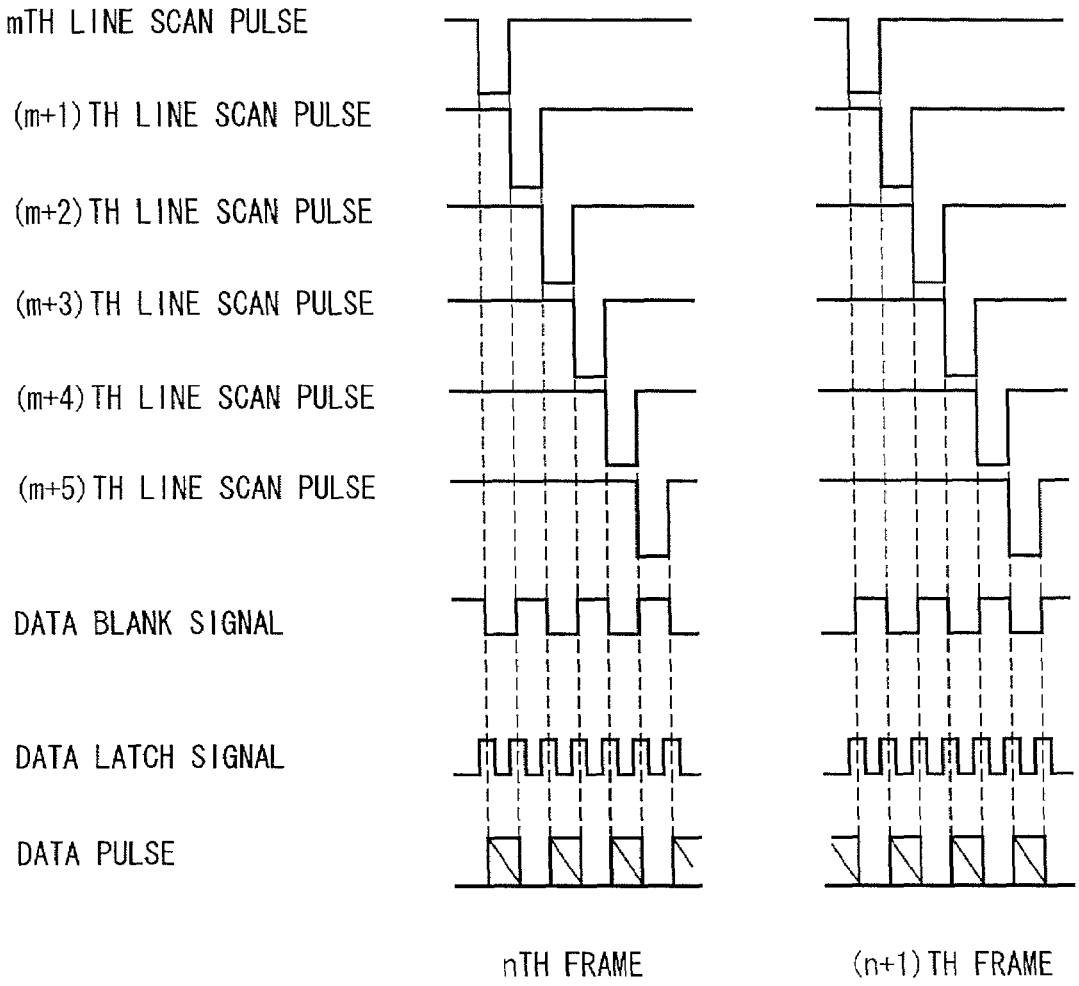
FIG. 4 is a timing chart showing a drive method for a plasma display panel according to a first embodiment of the present invention.

The following section specifically describes drive methods for a plasma display panel according to embodiments of the present invention while referring to the accompanied drawings. FIG. 4 is a timing chart showing a drive method for a plasma display panel according to a first embodiment of the present invention. One field comprises four subfields SF1 to SF4 in the first embodiment. It is assumed that the PIE control is conducted for expressing 11 gradation levels. FIG. 4 shows drive waveforms in the lowest subfield when the average peak level is high. Table 2 shows a relationship between the gradation level and selected subfields in the PIE control when the average peak level is high for the first embodiment.

TABLE 2

| | Subfield<br>Weight<br>Cycle number | SF1<br>1<br>1 | SF2<br>2<br>1 | SF3<br>4<br>2 | SF4<br>8<br>4 | Luminance |
|---|---|---|---|---|---|---|
| Gradation level | 0 | | | | | 0.84 |
| | 1 | ○ | | | | 1.46 |
| | 2 | | ○ | | | 2.08 |
| | 3 | ○ | ○ | | | 2.70 |
| | 4 | | | ○ | | 2.96 |
| | 5 | ○ | | ○ | | 3.58 |
| | 6 | | ○ | ○ | | 4.20 |
| | 7 | ○ | ○ | ○ | | 4.82 |
| | 8 | | | | ○ | 4.72 |
| | 9 | ○ | | | ○ | 5.30 |
| | 10 | | ○ | | ○ | 5.96 |

When the average peak level is low, and there are no subfields with the same sustain cycle numbers, all scan electrodes are scanned, and simultaneously data pulses according to the video signals are impressed on data electrodes in the first embodiment.

On the other hand, when the average peak level is high, and the sustain cycle numbers are equal in the lowest level subfield SF1 and the second lowest level subfield SF2 while there is a difference in the weight between the lowest level subfield SF1 and the second lowest level subfield SF2 as shown in Table 1, all scan electrodes are scanned, and simultaneously data pulses according to the video signals are impressed only on the odd number data electrodes or the even number data electrodes according to whether the field has an odd number or an even number as shown in FIG. 4 in the subfield SF1. Namely, for the lowest level subfield SF1 of an odd number filed (nth (n: odd number) frame), the data pulses are impressed on the data electrodes according to the video signal only when the odd number scan electrodes (corresponding to mth (m: odd number) line, (m+2)th line, (m+4)th line, . . . ) are scanned while a scan pulse is sequentially impressed on the all scan electrodes as shown in FIG. 4. For an even number filed ((n+1)th frame), the data pulses are impressed on the data electrodes according to the video signal only when the even number scan electrodes (corresponding to (m+1)th line, (m+3)th line, (m+5)th line, . . . ) are scanned while the scan pulse is sequentially impressed on the all scan electrodes.

Namely, one pixel comprises the display cells in three colors of R (red), G (green), and B (blue). The plurality of pixels arranged in the horizontal direction share a scan line. In a certain frame, for two scan lines next to each other in the vertical direction, one scan line is selectable, and receives the data pulses according to the video signals, and the other scan line is unselectable, and does not receive the data pulses at all. Then, in the following frame, the selectable scan lines and the unselectable scan lines are switched, and this switching is repeated for every frame.

To disable impressing the data pulses on the predetermined data electrodes regardless of the video signal, a data blank signal is activated in synch with the impressing timing as shown in FIG. 4, for example. When the data blank signal is activated, even if a data latch signal is activated in synch with the impressing timing of the scan pulse, the data pulse is not impressed on the corresponding data electrode.

Figure 5B:
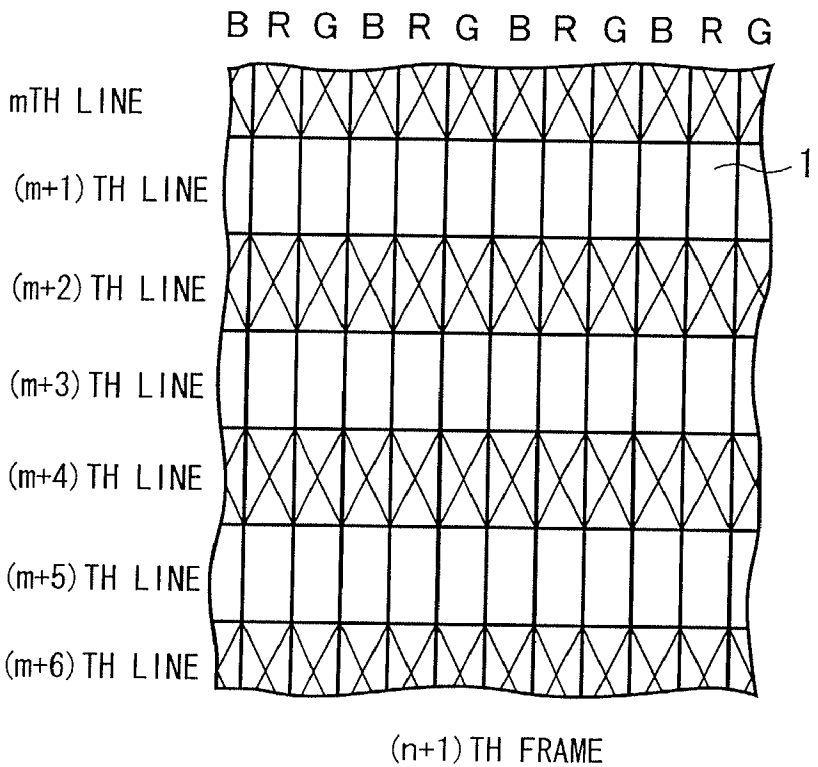
FIG. 5B is a schematic drawing showing the relationship in an (n+1)th frame.
Figure 5A:
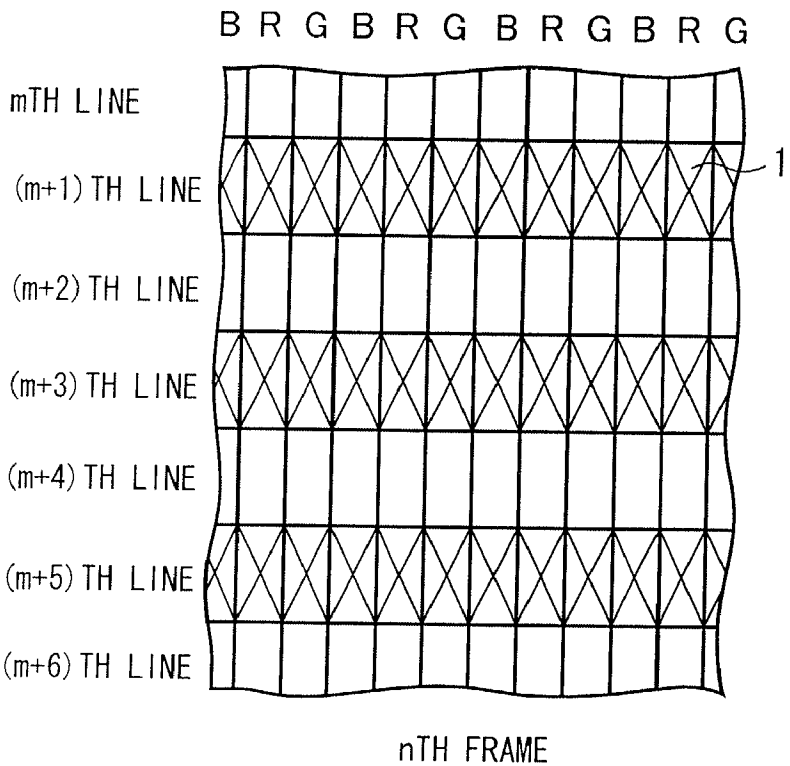
FIG. 5A is a schematic drawing showing the relationship in an nth frame.

FIG. 5 includes drawings showing a relationship between selectable display cells and unselectable display cells in the first embodiment of the present invention. FIG. 5A is a schematic drawing showing the relationship in an nth (odd number) frame, and FIG. 5B is a schematic drawing showing the relationship in an (n+1)th (even number) frame. The symbol "x" is added to show the unselectable display cells in FIG. 5A and FIG. 5B.

Figure 6:
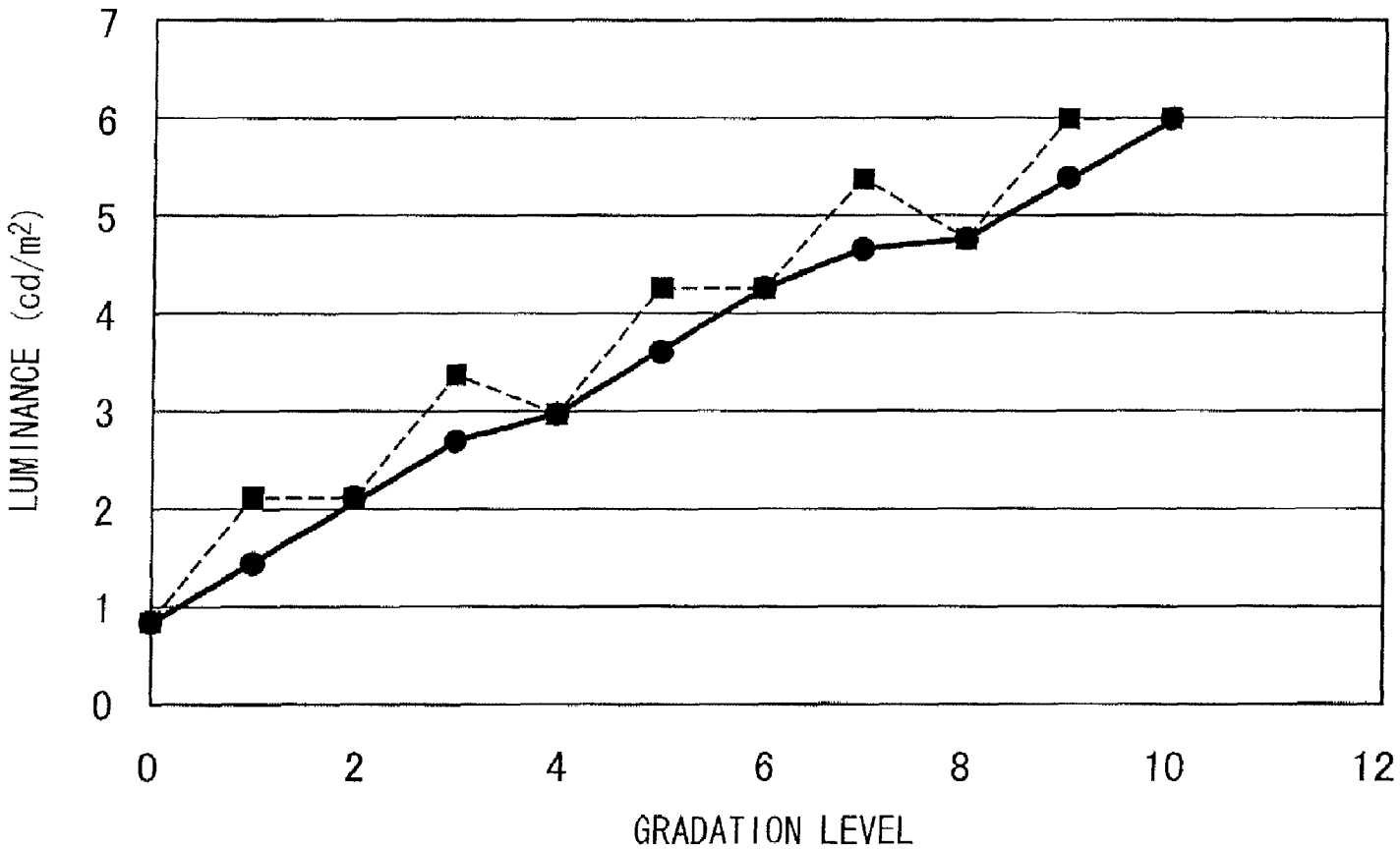
FIG. 6 is a chart showing a relationship between gradation level and luminance in Table 2.

The data pulses according to the video signals are impressed only on the odd data electrodes or only on the even data electrodes according to whether the field has an odd number or an even number in the present embodiment as described above. Even when the average peak level is high, and the subfield SF1 and the subfield SF2 have the same sustain cycle number, a write discharge does not occur for an odd number field when the scan pulse is impressed in the display cell 1 where the even number scan electrode is provided, and a write discharge does not occur for an even number field when the scan pulse is impressed in the display cell 1 where the odd number scan electrode is provided in the lowest level subfield SF1. As a result, the sustain cycle number for the lowest level subfield SF1 virtually becomes 0.5, which is a half of 1, and is a half of the sustain cycle number of the subfield SF2, which is on one upper level. Consequently, because the luminance increases as the gradation level increases, the reversal of the luminance which occurs in the conventional case does not occur as shown in Table 2. FIG. 6 is a chart for showing a relationship between the gradation level and the luminance in Table 2. A solid line in FIG. 6 shows the relationship in the first embodiment, and a broken line shows the relationship in the conventional case as a reference. While the reversal of the luminance occurs in the conventional drive method (the broken line), no reversal of the luminance occurs in the first embodiment (the solid line) as shown in FIG. 6.

Also, because all the scan electrodes are scanned in every frame, the screen does not momentarily become darker or brighter as in the conventional drive method which combines the interlace display for the lower level subfields. As a result, an excellent image quality is provided.

Figure 7A:
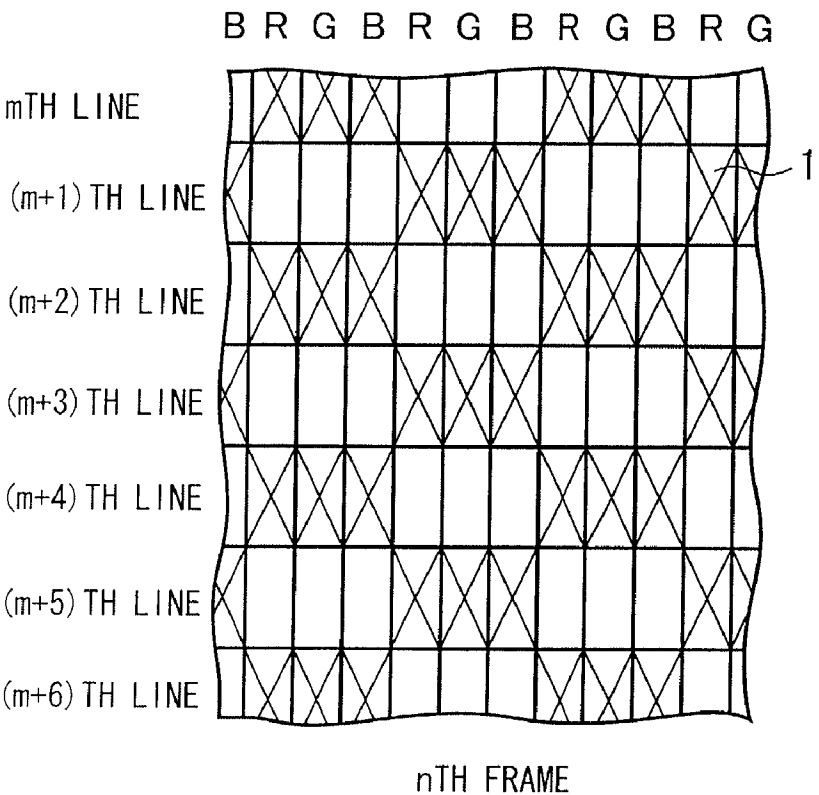
FIG. 7A is a schematic drawing showing the relationship in an nth frame.
Figure 7B:
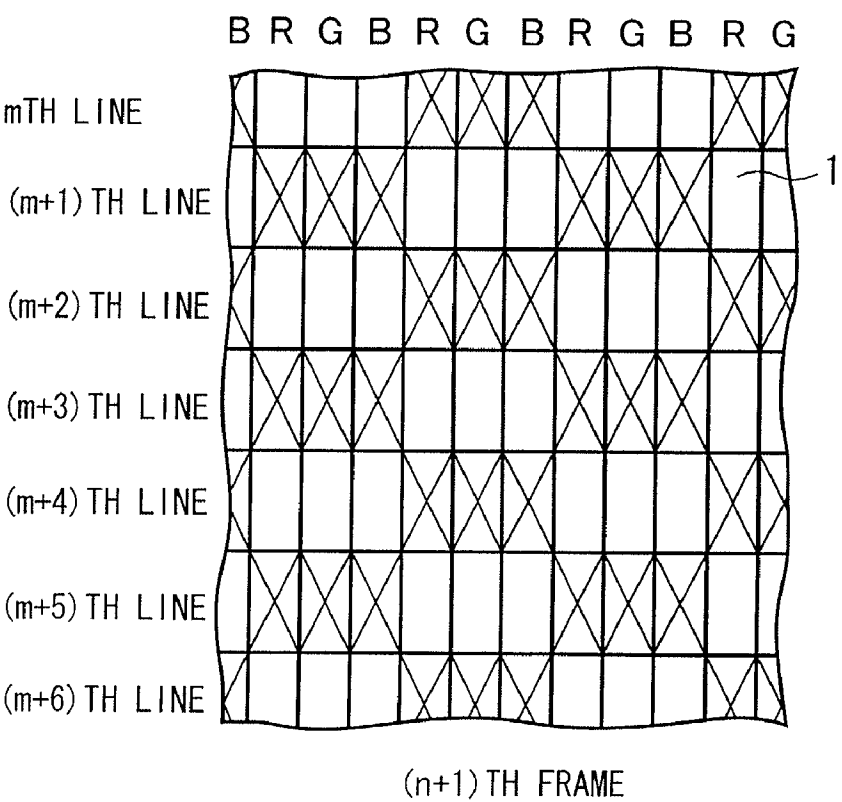
FIG. 7B is a schematic drawing showing the relationship in an (n+1)th frame.

The following section describes the second embodiment of the present invention. FIG. 7 includes drawings showing a relationship between selectable display cells and unselectable display cells in a second embodiment of the present invention. FIG. 7A is a schematic drawing showing the relationship in an nth frame, and FIG. 7B is a schematic drawing showing the relationship in an (n+1)th frame. The symbol "x" is added to show the unselectable display cells in FIG. 7A and FIG. 7B as in FIG. 5A and FIG. 5B.

In the second embodiment, the display method in the lowest subfield is different from that in the first embodiment when the average peak level is high. One pixel comprises the display cells 1 in three colors of R (red), G (green), and B (blue) as well in the second embodiment. For the two pixels next to each other in the horizontal direction in a certain frame, one pixel is selectable, and receives the data pulses according to the video signals on its data electrodes, and the other pixel is unselectable, and does not receive the data pulses at all. Simultaneously, for the two pixels next to each other in the vertical direction, one pixel is selectable, and receives the data pulses according to the video signals on its data electrodes, and the other pixel is unselectable, and does not receive the data pulses at all. Then, in the following frame, the selectable pixels and the unselectable pixels are switched, and this switching is repeated for every frame.

With the second embodiment, in the lowest subfield SF1, the selectable pixels receiving the data pulses are arranged in a checkerboard pattern, and the selectable state and the unselectable state are switched for all the pixels for every frame as shown in FIG. 7A and FIG. 7B. As a result, the sustain cycle number for the lowest level subfield SF1 virtually becomes 0.5, which is a half of 1, and is a half of the sustain cycle number of the subfield SF2, which is on one upper level. Consequently, because the luminance increases as the gradation level increases, the reversal of the luminance is prevented.

Because the selectable pixels are arranged as lines in the first embodiment, more or less flickers may occur. On the other hand, because the selectable pixels are arranged in a checkerboard pattern, no flickers occur in the second embodiment.

Figure 8A:
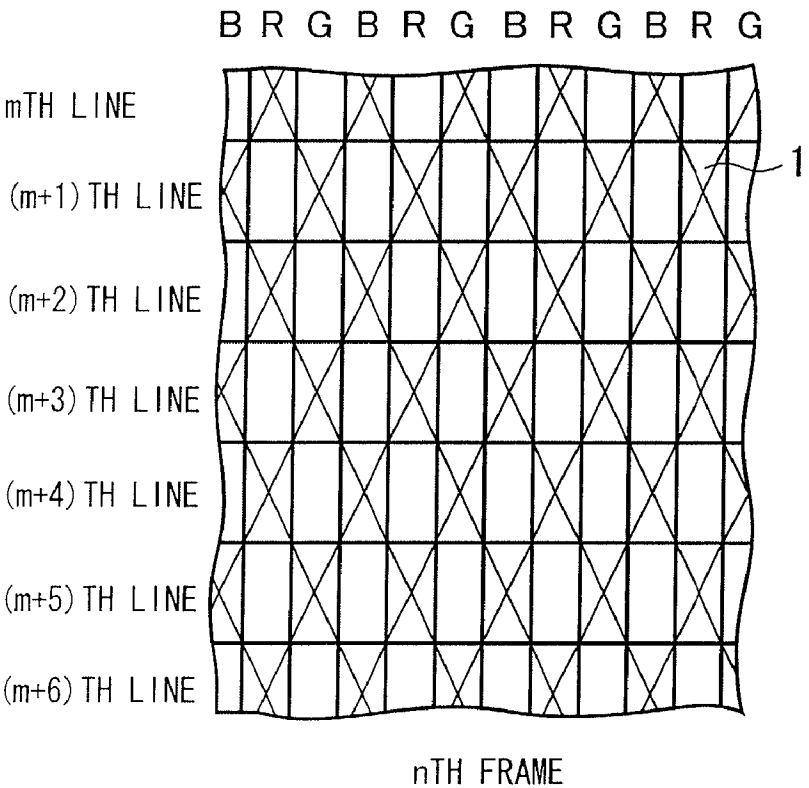
FIG. 8A is a schematic drawing showing the relationship in an nth frame.
Figure 8B:
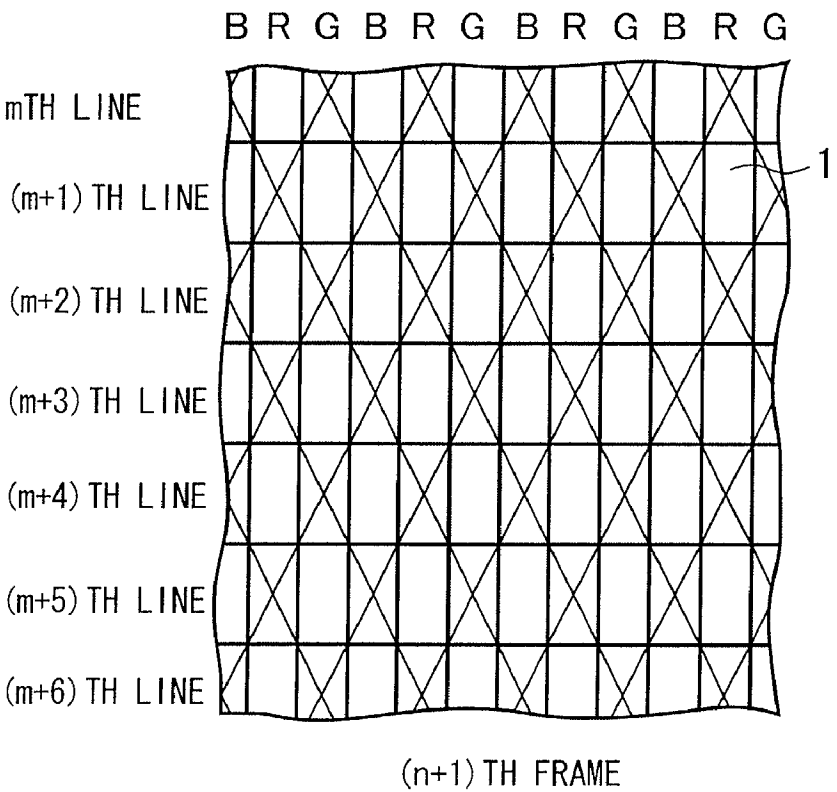
FIG. 8B is a schematic drawing showing the relationship in an (n+1)th frame.

The following section describes a third embodiment. FIG. 8 includes drawings showing a relationship between selectable display cells and unselectable display cells in the third embodiment of the present invention. FIG. 8A is a schematic drawing showing the relationship in an nth frame, and FIG. 8B is a schematic drawing showing the relationship in an (n+1)th frame. The symbol "x" is added to show the unselectable display cells in FIG. 8A and FIG. 8B as in FIG. 5A and FIG. 5B.

In the third embodiment, the display method is different from that in the first and second embodiments in the lowest level subfield SFwhen the average peak level is high. One pixel comprises the display cells 1 in three colors of R (red), G (green), and B (blue) as well in the third embodiment. For the two display cells 1 next to each other in the horizontal direction in a certain frame, one display cell 1 is selectable, and receives the data pulse according to the video signals on its data electrode, and the other display cell 1 is unselectable, and does not receive the data pulse at all. Simultaneously, for the two display cells 1 next to each other in the vertical direction, one display cell 1 is selectable, and receives the data pulse according to the video signals on its data electrode, and the other display cell 1 is unselectable, and does not receive the data pulse at all. Then, in the following frame, the selectable display cells 1 and the unselectable display cells 1 are switched, and this switching is repeated for every frame.

With the third embodiment, in the lowest level subfield SF1, the selectable display cells 1 for receiving the data pulses are arranged in a checkerboard pattern, the selectable state and the unselectable state for the all display cells 1 are switched for every frame as shown in FIG. 8A and FIG. 8B. As a result, the sustain cycle number for the lowest level subfield SF1 virtually becomes 0.5, which is a half of 1, and is a half of the sustain cycle number of the subfield SF2, which is on one upper level as in the first and second embodiments. Consequently, because the luminance increases as the gradation level increases, the reversal of the luminance is prevented.

Figure 9A:
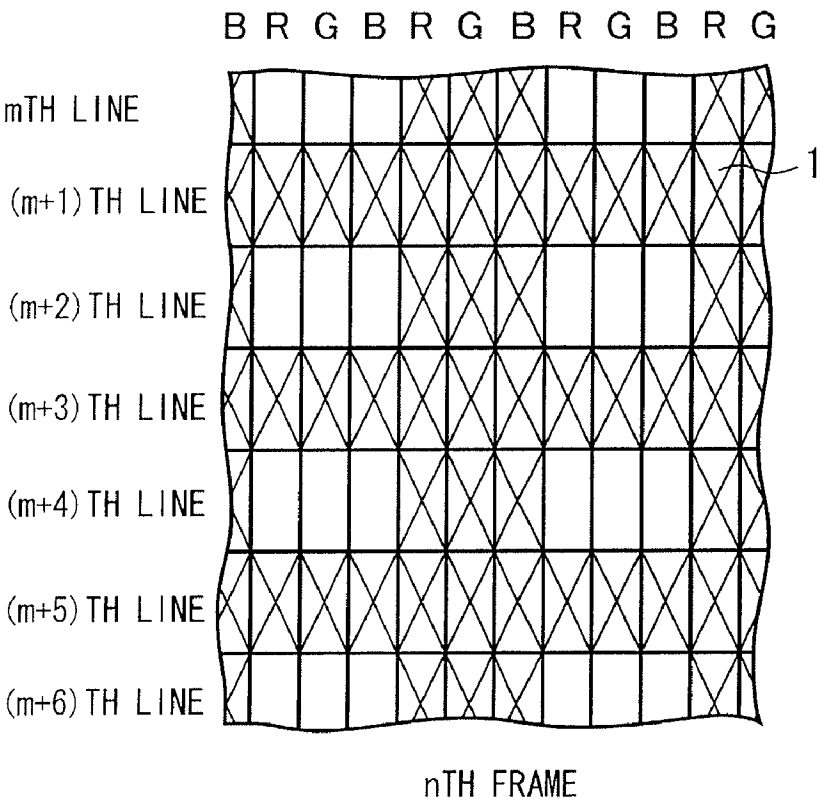
FIG. 9A is a schematic drawing showing the relationship in an nth frame.
Figure 9B:
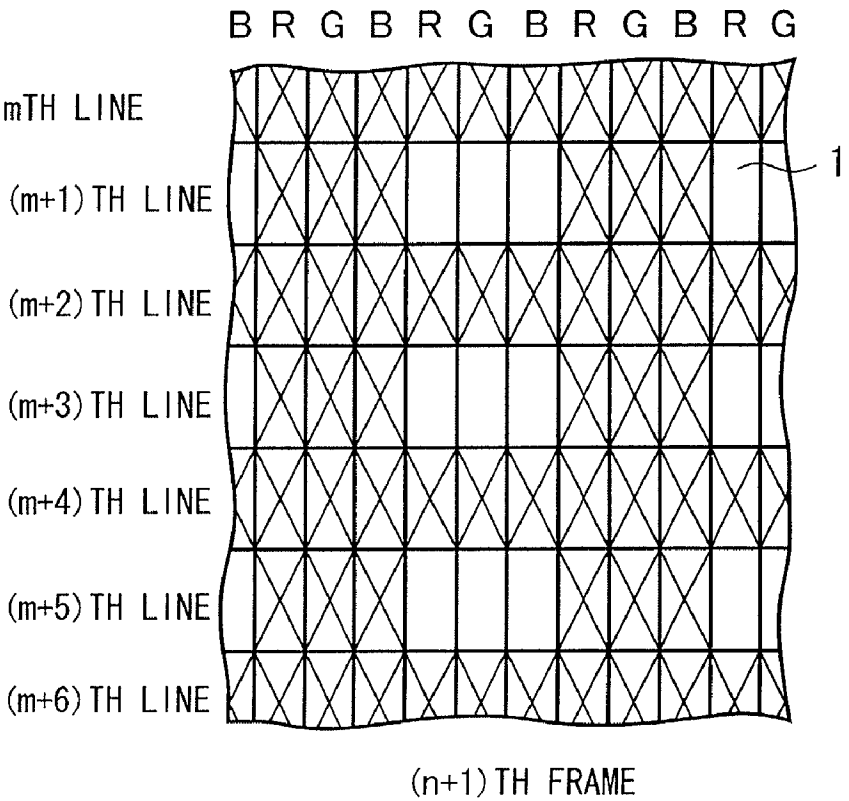
FIG. 9B is a schematic drawing showing the relationship in an (n+1)th frame.
Figure 10B:
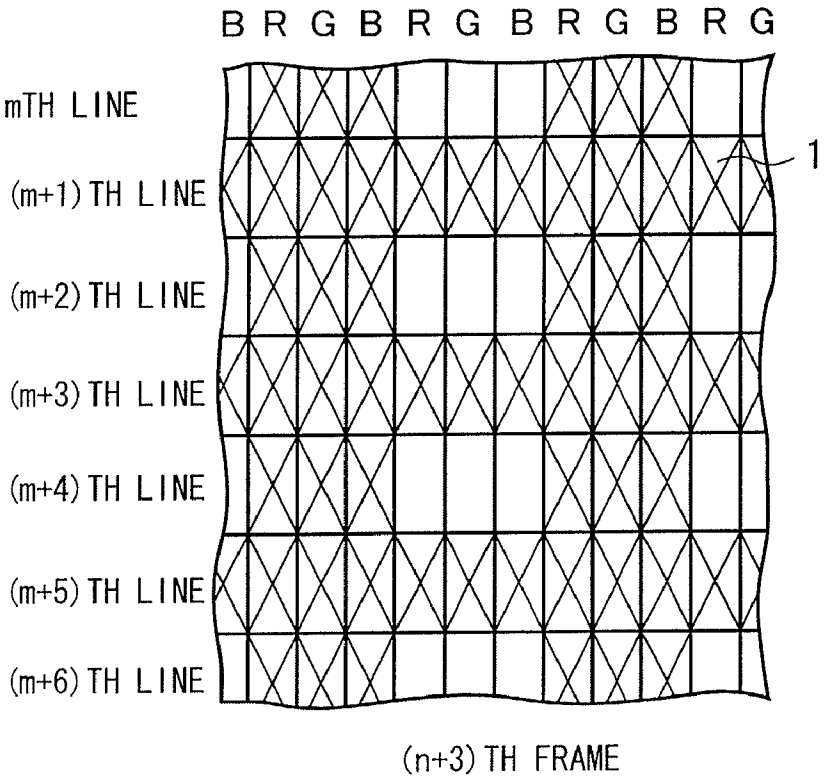
FIG. 10B is a schematic drawing showing the relationship in an (n+3)th frame.
Figure 10A:
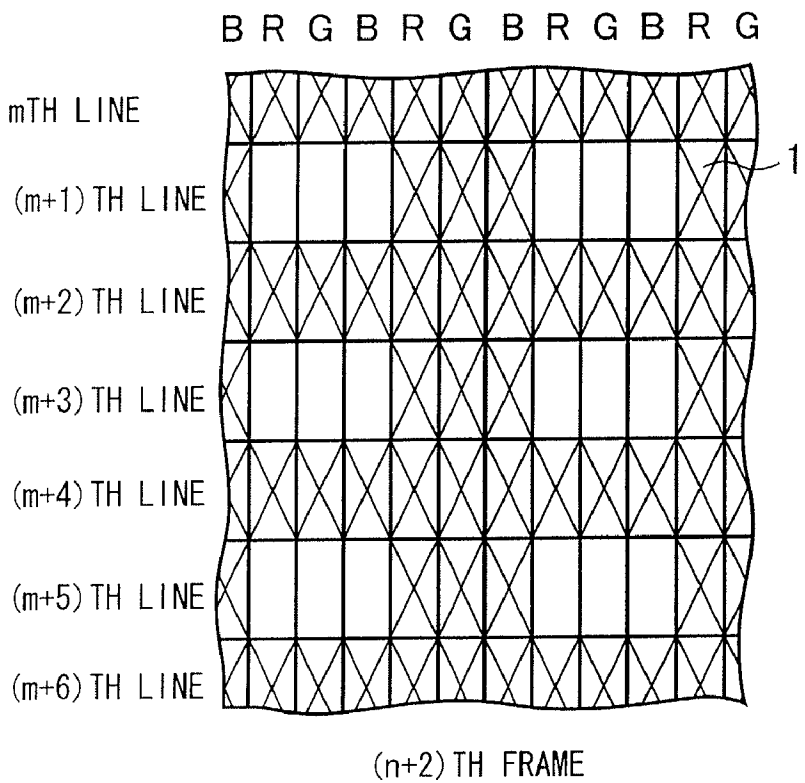
FIG. 10A is a schematic drawing showing the relationship in an (n+2)th frame.

The following section describes a fourth embodiment of the present invention. FIG. 9 and FIG. 10 includes drawings showing a relationship between selectable display cells and unselectable display cells in the fourth embodiment of the present invention. FIG. 9A is a schematic drawing showing the relationship in an nth frame, and FIG. 9B is a schematic drawing showing the relationship in an (n+1)th frame. FIG. 10A is a schematic drawing showing the relationship in an (n+2)th frame, and FIG. 10B is a schematic drawing showing the relationship in an (n+3)th frame. The symbol "x" is added to show the unselectable display cells in FIG. 9A, FIG. 9B, FIG. 10A, and FIG. 10B as in FIG. 5A and FIG. 5B.

In the fourth embodiment, the display method is different from that in the first to third embodiments in the lowest level subfield SFwhen the average peak level is high. One pixel comprises the display cells 1 in three colors of R (red), G (green), and B (blue) as well in the fourth embodiment. Only one fourth of the total pixels included in one screen are selectable for one frame. The individual pixels are selectable once in every four frames.

Specifically, the data pulses are not impressed on the data electrodes when the even number scan electrodes (corresponding to (m+1)th line, (m+3)th line, (m+5)th line, . . . ) are scanned in the nth frame as shown in FIG. 9A. When the odd number scan electrodes (corresponding to (m)th line, (m+2)th line, (m+4)th line, . . . ) are scanned, for the two display pixels next to each other in the horizontal direction, one pixel is selectable, and receives the data pulses according to the video signals on its data electrodes, and the other pixel is unselectable, and does not receive the data pulses at all. A pixel column comprises the pixels as many as the number of the scan lines included in that pixel column. For the two pixel columns next to each other, one pixel column has no selectable pixels. For the other pixel column, the pixels on the odd number scan lines are entirely selectable.

The data pulses are not impressed on the data electrodes when the odd number scan electrodes are scanned in the (n+1)th frame as shown in FIG. 9B. When the even number scan electrodes are scanned, the pixels between the pixels which are unselectable and are on the odd number lines in the vertical direction in the nth frame are selectable and receive data pulses according to the video signals on their data electrode. Simultaneously, the pixels between the pixels which are selectable, and are on the odd number lines in the vertical direction in the nth frame are unselectable, and do not receive the data pulses at all.

The data pulses are not impressed on the data electrodes when the odd number scan electrodes are scanned in the next (n+2)th frame as shown in FIG. 10A. When the even number scan electrodes are scanned, the pixels which are unselectable in the (n+1)th frame are selectable and receive data pulses according to the video signals on their data electrodes. Simultaneously, the pixels which are selectable in the (n+1)th frame are unselectable, and do not receive the data pulses at all.

The data pulses are not impressed on the data electrodes when the even number scan electrodes are scanned in the next (n+3)th frame as shown in FIG. 10B. When the odd number scan electrodes are scanned, the pixels which are unselectable in the nth frame are selectable and receive data pulses according to the video signals on their data electrode. Simultaneously, the pixels which are selectable in the nth frame are unselectable, and do not receive the data pulses at all.

Then, this switching between the selectable pixels and unselectable pixels is repeated for every four frames as a unit.

With the fourth embodiment, the sustain cycle number for the lowest level subfield SF1 virtually becomes 0.25, which is one fourth of 1, and is one fourth of the sustain cycle number of the subfield SF2, which is on one upper level. When the lowest level subfield SF1, the second lowest level subfield SF2, and the third lowest level subfield SF3 have the same sustain cycle number of 1, the following constitution provides a sufficient gradation display without a reversal of the luminance. For the subfield SF3, the sustain cycle number is maintained as 1. For the subfield SF2, any one of the embodiments 1 to 3 is used for virtually reducing the sustain cycle number by half to 0.5. For the subfield SF1, the embodiments 4 is used for virtually reducing the sustain cycle number to 0.25.

The unit for switching between the selectable state and the unselectable state is not limited to the display cell or the pixel. For example, a block is set per data driver with which the plurality of data electrodes are connected, and the selectable state and the unselectable state may be switched for this block as a unit. For the fourth embodiment, the states may be switched for the display cell as a unit as in the third embodiment instead of the pixel.

It is preferable not to apply error diffusion to the video signal in the column direction, and to apply the error diffusion only to the video signal in the row direction when the selectable state and the unselectable state is switched for every scan line as in the first embodiment. This corresponds to a case where an analog interface circuit 91 conducts signal processing such as the error diffusion and dithering independently to halftone processing conducted by parts on a PDP side after a digital processing circuit 92 in a plasma display device shown in FIG. 11 described later. This constitution prevents a generation of a moire pattern and the like as a result of an interaction between the signal processing and the drive method of the present invention.

Figure 11:
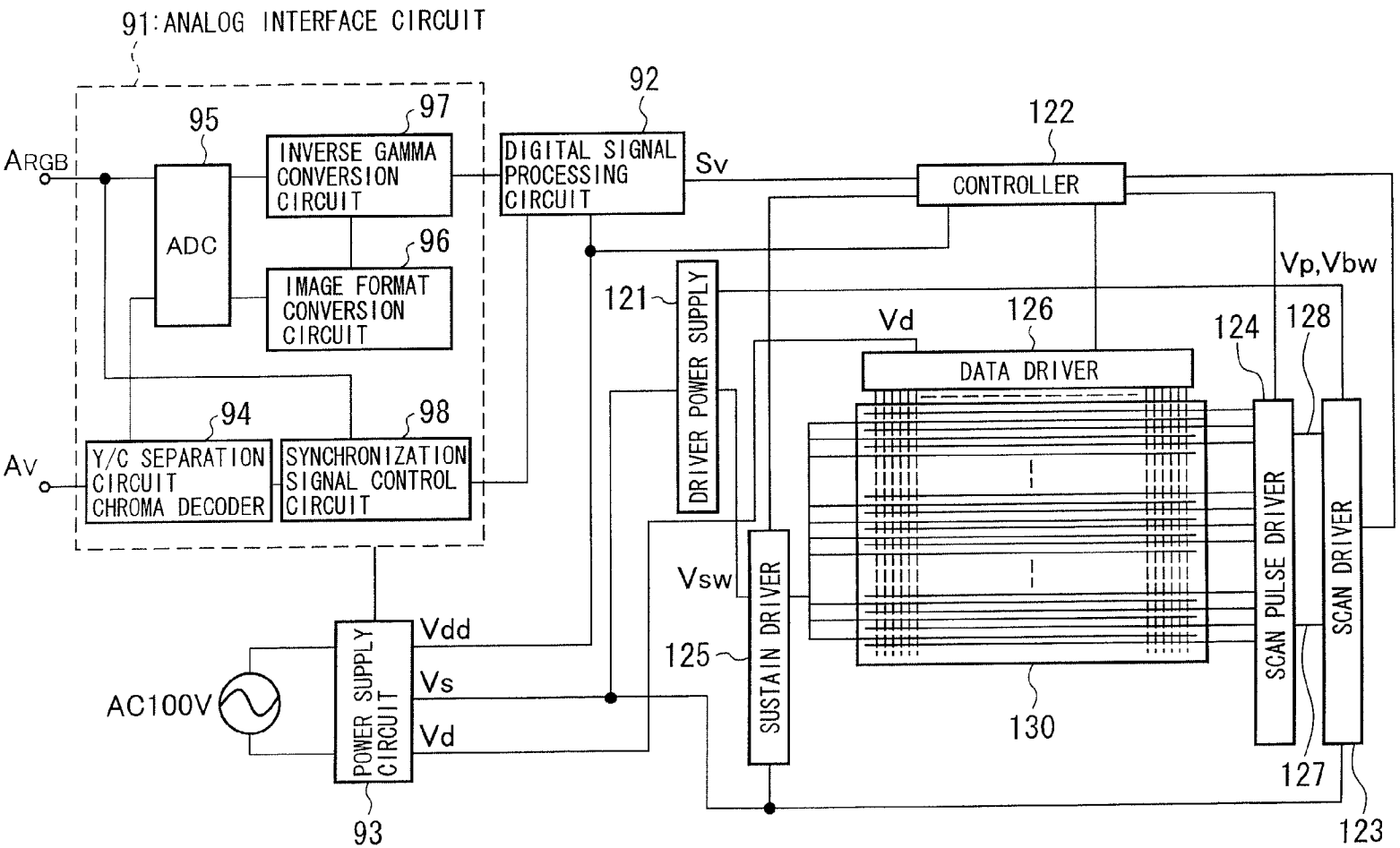
FIG. 11 is a block diagram showing an example of a constitution of a plasma display device (a PDP multimedia monitor) according to the embodiments of the present invention.

The plasma display device according to these embodiments can be used as a display device such as a television receiver and a computer monitor. FIG. 11 shows an example of a constitution of a plasma display device (a PDP multimedia monitor) according to the embodiments of the present invention. In this plasma display device, a sustain driver 125 connected with the sustain electrodes, a scan pulse driver 124 connected with the scan electrodes, a scan driver 123 connected on a prior stage of the scan pulse driver 124, and a data driver 126 connected with the data electrodes as drive circuits for a PDP 130, a driver power supply 121 for supplying the drive circuits with a power supply voltage, and a controller 122 for controlling the operation of the drive circuits are provided. Further, an analog interface circuit 91 and the digital signal processing circuit 92 are provided on a stage before the constitution elements described above. A power supply circuit 93 is provided for supplying individual parts of the device with DC voltages from AC 100 V. A Y/C separation circuit and a chroma decoder 94, an analog/digital converter (ADC) 95, an image format conversion circuit 96, an inverse gamma conversion circuit 97, and a synchronization signal control circuit 98 constitute an analog interface circuit 91.

The Y/C separation circuit and the chroma decoder 94 are circuits which separate an analog video signal $A_v$ into a red (R) luminance signal, a green (G) luminance signal, and a blue (B) luminance signal respectively when this display is used as a display for a television receiver. The ADC 95 converts analog RGB signals $A_{RGB}$ into digital RGB signals when this display device is used as a monitor for a computer and the like. The ADC 95 converts the individual luminance signals in R, G, and B supplied from the Y/C separation circuit and the chroma decoder 94 into the individual digital luminance signals in R, G, and B when this display is used as a display for a television receiver. The image format conversion circuit 96 converts a pixel constitution of the individual digital luminance signals in R, G, and B so as to match a pixel constitution of the PDP 130 when there is a difference in the pixel constitution between the individual digital luminance signals in R, G, and B supplied from the ADC 95, and the PDP 130. The inverse gamma conversion circuit 97 applies inverse gamma correction such that the property of the digital RGB signals after gamma correction for matching a gamma characteristic of a CRT display matches a linear gamma characteristic of the PDP 130, or the characteristic of the individual digital luminance signals in R, G, and B from the image format conversion circuit 96 matches the linear gamma characteristic of the PDP 130. The synchronization signal control circuit 98 is a circuit for generating a sampling clock signal for the ADC 95, and a data clock signal based on a horizontal synchronization signal supplied along with the analog video signal $A_v$. The digital signal processing circuit 92 provides the controller 122 with a video signal $S_v$.

The power supply circuit 93 generates a logic voltage Vdd, a data voltage Vd, and a sustain voltage Vs from AC 100 V. The driver power supply 121 generates a priming voltage Vp, a scan base voltage Vbw, and a bias voltage Vsw based on the sustain voltage Vs supplied from the power supply circuit 93. The PDP 130, the controller 122, the driver power supply 121, the scan driver 123, the scan pulse driver 124, the sustain driver 125, the data driver 126, and the digital signal processing circuit 92 are modularized. This plasma display device can be applied to any one of the embodiments described above.

As detailed above, with the present invention, when the predetermined number of the display cells in a subfield is a half of the number of the total display cells of the plasma display, the luminance is reduced by half in that subfield. When the predetermined number of the display cells in the subfield is one fourth of the number of the total display cells, the luminance is reduced to one fourth in that subfield. Thus, even when there are two subfields whose sustain cycle number is 1 as a result of the PLE control, if the number of the predetermined display cells is a half of the total number of the display cells in one of the subfields such as a lower level subfield, the reversal of the luminance is prevented. Simultaneously, because it is not necessary to skip the scan pulse, the screen does not momentarily become darker or brighter, and an excellent image quality is provided.

What is claimed is:

1. A method for driving a plasma display panel in which one field is constituted by a plurality of subfields, comprising the steps of:

impressing data pulses on data electrodes provided on individual display cells in one or more subfields of said plurality of subfields in association with a video signal to generate a write discharge for a gradation display on the plasma display panel; and assigning a sustain cycle number to at least one subfield of said plurality of subfields in accordance with luminance of the video signal, said sustain cycle number being equal to that assigned to the other subfield, and said at least one subfield having a weight lower than that for the other subfield, wherein said step of impressing the data pulses includes impressing the data pulses only on the data electrodes of predetermined display cells which is a part of all display cells without generating the write discharge in the remaining display cells in said at least one subfield of said plurality of subfields such that the sustain cycle number in said at least one subfield becomes virtually 1/N, the N being an integer equal to 2 or more.

2. The method for driving a plasma display panel according to claim 1, wherein the sustain cycle number equal to that assigned to the other subfield is 1.

3. The method for driving a plasma display panel according to claim 2, wherein said predetermined display cells constitute scan lines, the scan lines constituted by said predetermined display cells are provided at a ratio of one scan line in every N scan lines, and the data pulses are not impressed on the data electrodes on the remaining (N−1) scan lines.

4. The method for driving a plasma display panel according to claim 3, wherein error diffusion is conducted only for data in the horizontal direction for said video signal.

5. The method for driving a plasma display panel according to claim 2, wherein said predetermined display cells constitute pixels, the pixels constituted by said predetermined display cells are provided at a ratio of one pixel in every N pixels, and the data pulses are not impressed on the data electrodes for the remaining (N−1) pixels.

6. The method for driving a plasma display panel according to claim 2, wherein said predetermined display cells constitute blocks, the blocks constituted by said predetermined display cells are provided at a ratio of one block in every N blocks, and the data pulses are not impressed on the data electrodes for the remaining (N−1) blocks.

7. The method for driving a plasma display panel according to claim 6, wherein one data driver is connected with data electrodes for said individual blocks.

8. The method for driving a plasma display panel according to claim 1, wherein a plurality of total sustain cycle numbers are set in advance, said method further comprising the step of selecting one of a total sustain cycle number from said plurality of the total sustain cycle numbers in association with an average peak level of said video signal before the step of impressing the data pulses associated with the video signal only on the data electrodes of said predetermined display cells.

9. The method for driving a plasma display panel according to claim 1, wherein said predetermined display cells are changed once in every M fields, the M being an integer equal to 2 or more.

10. The method for driving a plasma display panel according to claim 9, wherein the sustain cycle number equal to that assigned to the other subfield is 1, and the value of M is equal to the value of N.

11. A plasma display device comprising: a plasma display panel; and a drive device for using the method according to claim 1 to drive the plasma display panel.

* * * * *